US011453107B2

(12) United States Patent
Lin et al.

(10) Patent No.: US 11,453,107 B2
(45) Date of Patent: Sep. 27, 2022

(54) APPARATUS FOR INSTALLING EXPLOSIVELY DRIVEN FASTENERS

(71) Applicants: Joe Lin, Missouri City, TX (US); Brian Liu, Houston, TX (US)

(72) Inventors: Joe Lin, Missouri City, TX (US); Brian Liu, Houston, TX (US)

( * ) Notice: Subject to any disclaimer, the term of this patent is extended or adjusted under 35 U.S.C. 154(b) by 0 days.

(21) Appl. No.: 16/797,787

(22) Filed: Feb. 21, 2020

(65) Prior Publication Data

US 2021/0260740 A1 Aug. 26, 2021

(51) Int. Cl.
*B25C 1/08* (2006.01)

(52) U.S. Cl.
CPC ..... *B25C 1/085* (2013.01)

(58) Field of Classification Search
CPC ..... B25C 1/085
USPC ..... 227/9
See application file for complete search history.

(56) References Cited

U.S. PATENT DOCUMENTS 3,610,504 A * 10/1971 Oesterle ..... B25C 1/143 227/8
3,622,060 A * 11/1971 Gussalli ..... B25C 1/143 227/8
3,688,964 A * 9/1972 De Caro ..... B25C 1/087 227/10
3,949,921 A * 4/1976 Brack ..... B25C 1/085 227/9
5,016,802 A * 5/1991 Haytayan ..... B25C 1/082 173/DIG. 2
5,904,284 A * 5/1999 Lin ..... B25C 1/082 227/11
6,364,190 B1 * 4/2002 Tor ..... B25C 1/14 227/10
7,097,085 B2 * 8/2006 Arnold ..... B25C 1/10 227/10
7,896,210 B2 * 3/2011 Popovich ..... B25C 1/14 227/8
2011/0198382 A1 * 8/2011 Masas ..... B25C 1/12 227/9
2012/0321413 A1 * 12/2012 Masas ..... B25C 1/163 411/440
2020/0139527 A1 * 5/2020 Lin ..... B25C 1/12

* cited by examiner

*Primary Examiner* — Thomas M Wittenschlaeger
*Assistant Examiner* — Katie L Gerth
(74) *Attorney, Agent, or Firm* — John R Casperson

(57) ABSTRACT

For a spring tool for actuating explosive fasteners to operate at its maximum potential the firing pin guide should be pushed securely against the rear of the fastener and the tip of the fastener should be pushed securely against the substrate. To achieve this, the action of the operator pushing the tool forward to actuate the tool moves the trigger body forward while compressing the firing spring until the trigger body travels the exact distance needed to release the trigger ball. A step or backstop insert is added to the inside of the trigger body such that at the exact distance where the trigger ball is released, the step contacts the rear of the firing pin guide so that all internal components of the tool to form a solid (contacting) stack, from the tip of the fastener to the end cap of the tool.

13 Claims, 8 Drawing Sheets

APPARATUS FOR INSTALLING EXPLOSIVELY DRIVEN FASTENERS

FIELD OF THE INVENTION

This invention relates broadly to explosively driven fasteners. More particularly, this invention relates to an apparatus for installing explosively driven fasteners.

BACKGROUND OF THE INVENTION

For applying explosively driven fasteners to a substrate, power charges and nail lengths are all individually optimized for a given application. It would be desirable to optimize the tool to match.

OBJECTS OF THE INVENTION

It is an object of this invention to provide a spring energized tool for applying explosively driven fasteners that has a positive stop and is not springy when fully energized.

SUMMARY OF THE INVENTION

Preferred embodiments of the invention provide tools for installing an explosively driven fastener, the fastener including a nail and an explosive load attached to the nail.

The tool comprises an outer cover sleeve defining a bore, a longitudinal axis, a proximal end and a distal end. A generally tubular trigger body is fixedly positioned in the outer cover sleeve. The bore of the trigger body has a distally facing arcuate backstop face.

An end cap is positioned at the proximal end of the trigger body securing the trigger body to the outer cover sleeve.

A firing pin holder is located within the bore of the generally tubular trigger body and extends along the longitudinal axis of the trigger body. The firing pin holder has a proximal end and a distal end.

A firing spring is arranged to bias the firing pin holder distally with respect to the trigger body.

A firing pin is provided having a proximal end and a distal end. The distal end is pointed. The firing pin is separate from the firing pin holder. The proximal end of the firing pin is removably coupled to the distal end of the firing pin holder.

A nosepiece is provided having a proximal end and a distal end. The proximal end is arranged to receive a firing pin guide and the distal end is arranged to receive the fastener comprising the nail and the explosive load such that when the fastener is placed in the distal end of the nosepiece and the firing pin holder is biased out of the outer cover sleeve by the firing spring, the firing pin strikes the explosive load causing the explosive load to explode and drive the nail out of the nosepiece.

A tubular reset sleeve is provided having an inner flange facing distally and an outer flange facing proximally.

The firing pin guide is carried slidably in the reset sleeve. The firing pin guide has a distal end and a proximal end, a proximally facing outer arcuate flange abuttable against the inner flange of the reset sleeve, and an arcuate face at its proximal end abuttable against the inside distally facing arcuate backstop face in the generally tubular trigger body.

A reset spring is mounted around the firing pin guide and abuts the outer flange of the reset sleeve. The reset spring biases the reset sleeve distally.

A trigger ball and a trigger ball spring are mounted transversely in the firing pin holder. The trigger ball is biased radially outward from within the firing pin holder.

The firing pin guide has a slot extending from the proximal end and a widened area in the slot to receive the trigger ball.

When the tool is in an energized position, the trigger ball rests in the widened area of the slot thereby limiting distal movement of the firing pin, and the arcuate end face of the firing pin guide abuts or nearly abuts the arcuate backstop face in the trigger body.

For the tool to operate at its maximum potential the firing pin guide should be pushed securely against the rear of the fastener and the tip of the fastener should be pushed securely against the substrate.

The action of the operator pushing the tool forward to actuate the tool moves the trigger body forward while compressing the firing spring until the trigger body travels the exact distance needed to release the trigger ball.

A step or backstop insert is added to the inside of the trigger body. The step is designed such that at the exact distance where the trigger ball is released, the step contacts the rear of the firing pin guide. The firing pin guide cannot move backwards.

The stop allows all internal components to form a solid stack, wherein the internal elements are contacting each other, from tip of the pin assembly to the end cap. The forward pressure of the operator actuating the tool keeps the tip of the pin assembly pressed firmly against the substrate while the firing pin impacts the load.

DETAILED DESCRIPTION OF THE INVENTION

Figure 1:
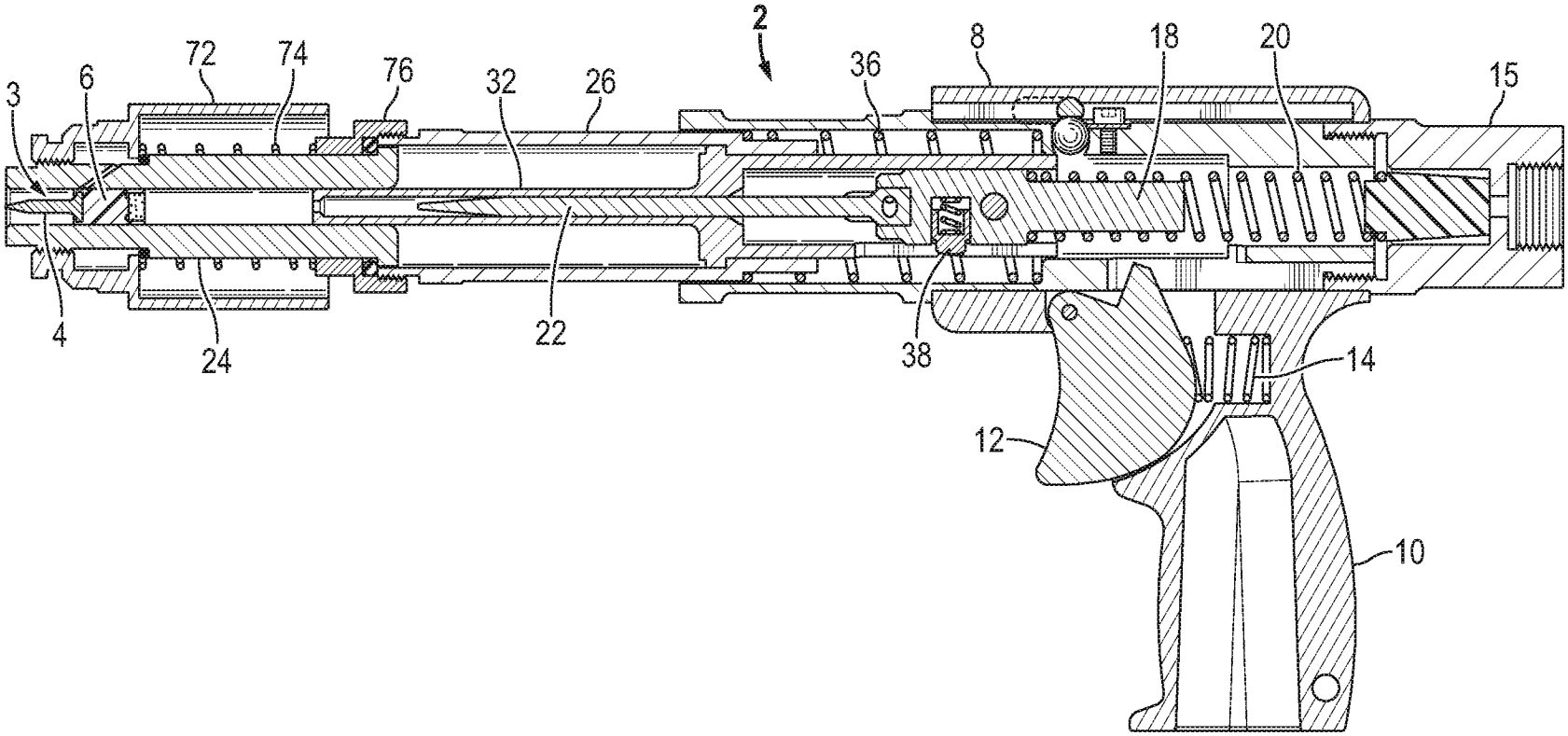
FIG. 1 is a longitudinal sectional view of a tool according to a first embodiment of the invention with the springs in unenergized states. The tool carries a fastener assembly comprising a nail and an explosive charge in its nosepiece.
Figure 2:
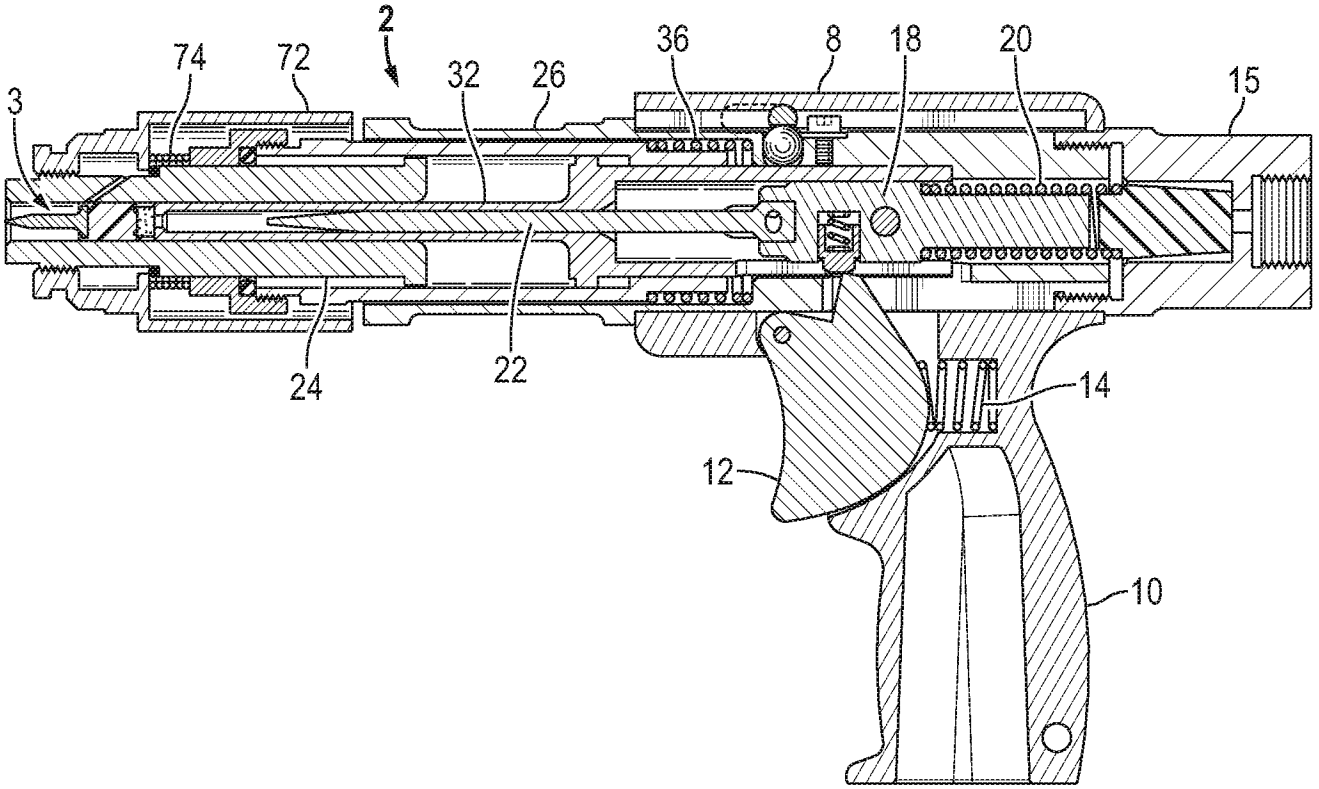
FIG. 2 is a longitudinal sectional view of the tool in FIG. 1 with the springs in an energized state. Internal components of the tool form a solid stack, from tip of the pin assembly to the end cap. By solid is meant that the solid components are contacting each other.
Figure 3:
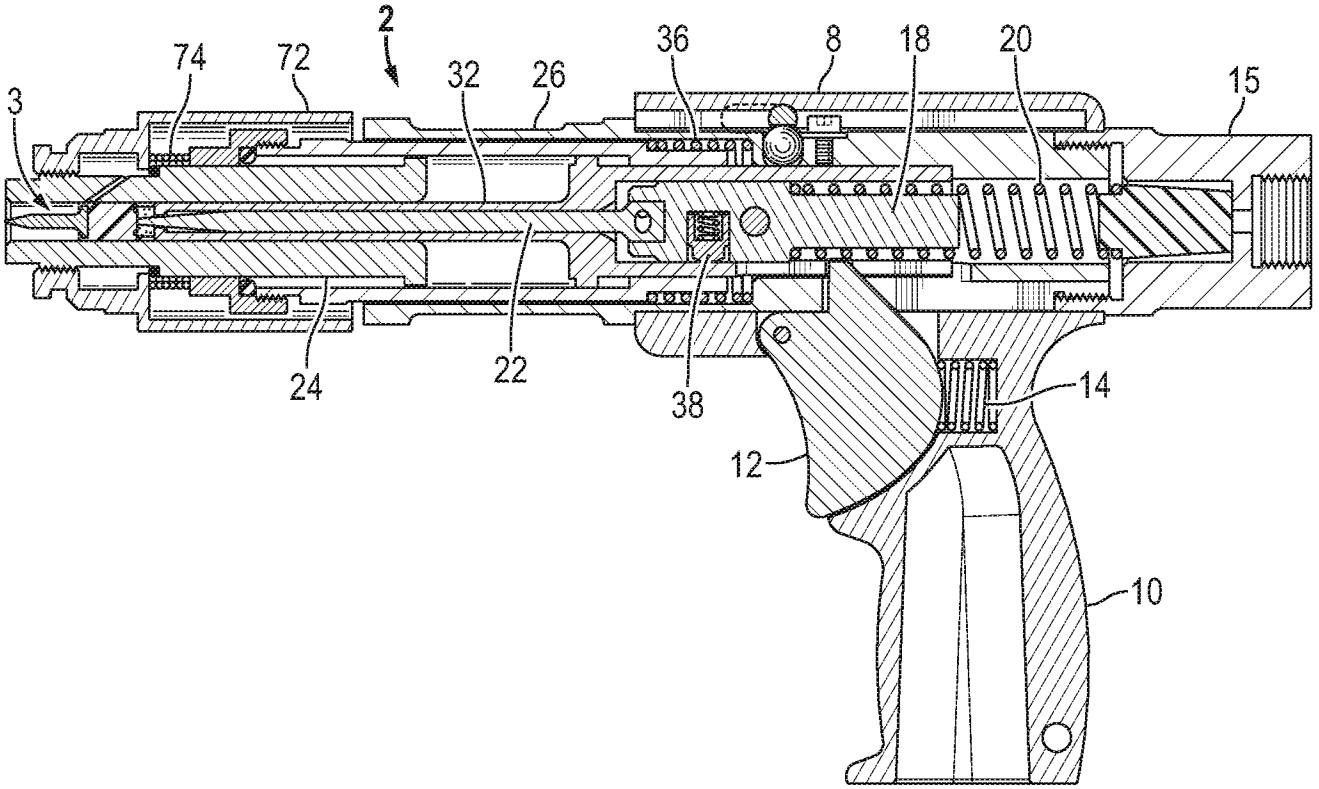
FIG. 3 is a longitudinal sectional view of the tool in FIGS. 1 and 2 after release of the firing pin to strike the explosive charge.

In the drawings, like parts in different equipment are called out by the same callout numerals.

Preferred embodiments of the invention provide tools 2, 102 for installing an explosively driven fastener 3, the fastener including a nail 4 and an explosive load 6 attached to the nail.

The tool comprises an outer cover sleeve 8, 108 defining a bore 202, a longitudinal axis 204, a proximal end 206 and a distal end 208. A generally tubular trigger body 13 is fixedly positioned in the outer cover sleeve. The bore 210 of the trigger body has a distally facing arcuate backstop face 11, 111, preferably a generally annular face.

An end cap 15, 115 is positioned at the proximal end 212 of the trigger body securing the trigger body to the outer cover sleeve.

A firing pin holder 18 is located within the bore of the generally tubular trigger body and extends along the longitudinal axis 214 of the trigger body. The firing pin holder has a proximal 216 end and a distal end 218.

A firing spring 20 is arranged to bias the firing pin holder distally with respect to the trigger body.

A firing pin 22 is provided having a proximal end 220 and a distal end 222. The distal end is pointed. The firing pin is separate from the firing pin holder. The proximal end of the firing pin is removably coupled to the distal end of the firing pin holder.

A nosepiece 24, 124 is provided having a proximal 224 end and a distal end 226. The proximal end is arranged to receive a firing pin guide 32 and the distal end is arranged to receive the fastener comprising the nail and the explosive load such that when the fastener is placed in the distal end of the nosepiece and the firing pin holder is biased out of the outer cover sleeve by the firing spring, the firing pin strikes the explosive load causing the explosive load to explode and drive the nail out of the nosepiece.

A tubular reset sleeve 26 is provided having an inner flange 28 facing distally and an outer flange 30 facing proximally.

The firing pin guide is carried slidably in the reset sleeve. The firing pin guide has a distal end 228 and a proximal end 230, a proximally facing outer annular flange 34 abuttable against the inner flange of the reset sleeve, and an annular face 232 at its proximal end abuttable against the inside distally facing arcuate backstop face in the generally tubular trigger body.

A reset spring 36 is mounted around the firing pin guide and abuts the outer flange of the reset sleeve. The reset spring biases the reset sleeve distally.

A trigger ball 38 and a trigger ball spring 40 are mounted transversely in the firing pin holder. The trigger ball is biased radially outward from within the firing pin holder.

The firing pin guide has a slot 50 extending from the proximal end and a widened area 52 in the slot to receive the trigger ball.

When the tool is in an energized position, the trigger ball rests in the widened area of the slot thereby limiting distal movement of the firing pin, and the arcuate preferably annular end face of the firing pin guide abuts or nearly abuts the arcuate preferably annular backstop face in the trigger body.

Figure 8:
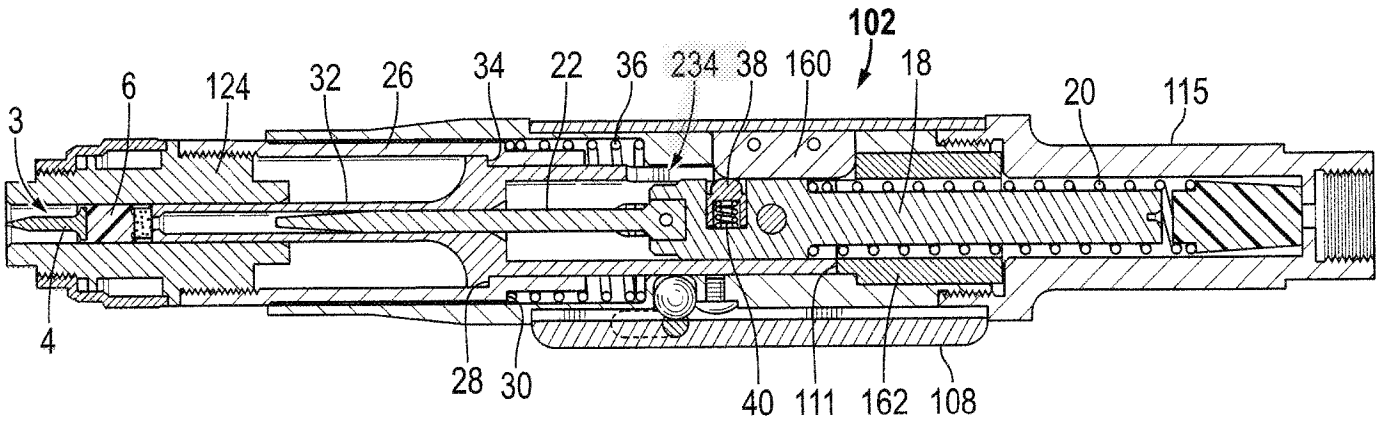
FIG. 8 is a longitudinal sectional view of a tool according to a second embodiment of the invention with the springs in energized states.
Figure 9:
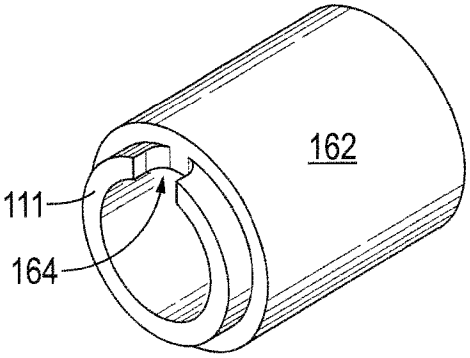
FIG. 9 is a pictorial illustration of a part shown in FIG. 8 showing additional features.

In one embodiment of the invention, (FIG. 8), an internal trigger shoe 160 extends radially inwardly into the bore of the trigger body at a distal location from the distally facing arcuate backstop face. The shoe is receivable by the keyway 234 to depress the trigger ball by sliding over it. When the tool is in a firing position, as shown in FIG. 8, the trigger shoe depresses the trigger ball out of engagement with the firing pin guide allowing distal movement of the firing pin under the action of the firing spring as the arcuate end face of the firing pin guide abuts the arcuate backstop face in the trigger body. In one embodiment, the distally facing arcuate backstop face is an end face of a tubular backstop 162 carried internally at the proximal end of the trigger body. The backstop in the tool can thus be a separate or an integral part. If needed for proper stack height, the arcuate backstop face of tubular backstop can define a notch 164 to partially accommodate the trigger shoe. The tubular backstop can be press fitted into the trigger body. The overall stack length can be adjusted, if necessary, by placing spacer(s), for example, washer(s), between the nosepiece and the reset sleeve.

In one embodiment of the invention, a grip 10 extends transversely from the outer cover sleeve between the proximal end and the distal end. A trigger 12 is pivotally connected to the outer cover sleeve and biased distally away from the grip by a trigger spring 14 positioned between the grip and the trigger. The trigger has an upper surface and a nose 16 protruding from its upper surface toward the longitudinal axis of the outer cover sleeve. The nose enters the bore of the outer cover sleeve when the trigger is depressed toward the grip. The generally tubular trigger body defines a longitudinally extending slot 70 which receives the nose of the trigger when the trigger is depressed toward the grip. When the tool is in a firing position, the trigger nose depresses the trigger ball out of engagement with the firing pin guide to allow distal movement of the firing pin under the action of the firing spring.

In one embodiment of the invention, the distally facing arcuate backstop face of the generally tubular trigger body comprises an annular step in the bore of the trigger body and is unitary with the trigger body.

One embodiment of the invention further comprises a blocking element 41 carried for radial movement by generally tubular trigger body to selectively block proximal movement of the firing pin guide and prevent energization of the firing pin spring. A cam 42 is mounted across the outer cover sleeve, and an arm 236 is positioned on one end of the cam to permit about a 90 degree rotation of the cam to selectively block radially outward movement of the blocking element and prevent the firing pin guide from moving sufficiently proximally for the firing pin spring to be energized. The safety is preferably a ball bearing that contacts the distal end of the firing pin guide.

Figure 4:
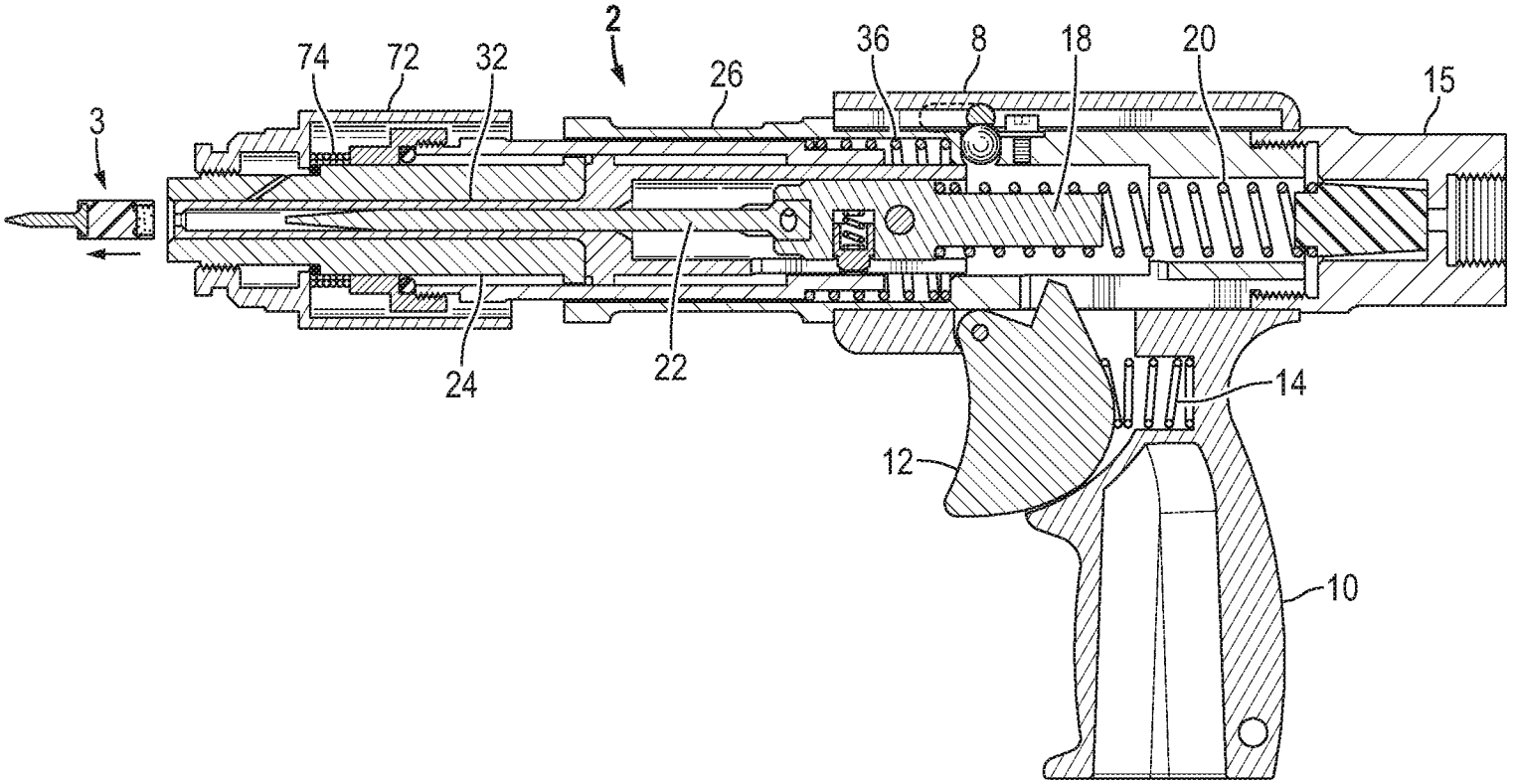
FIG. 4 is a longitudinal sectional view of the tool as shown in FIGS. 1-3 showing ridding the nosepiece of a fastener assembly in the event of misfire or change of mind.
Figure 5:
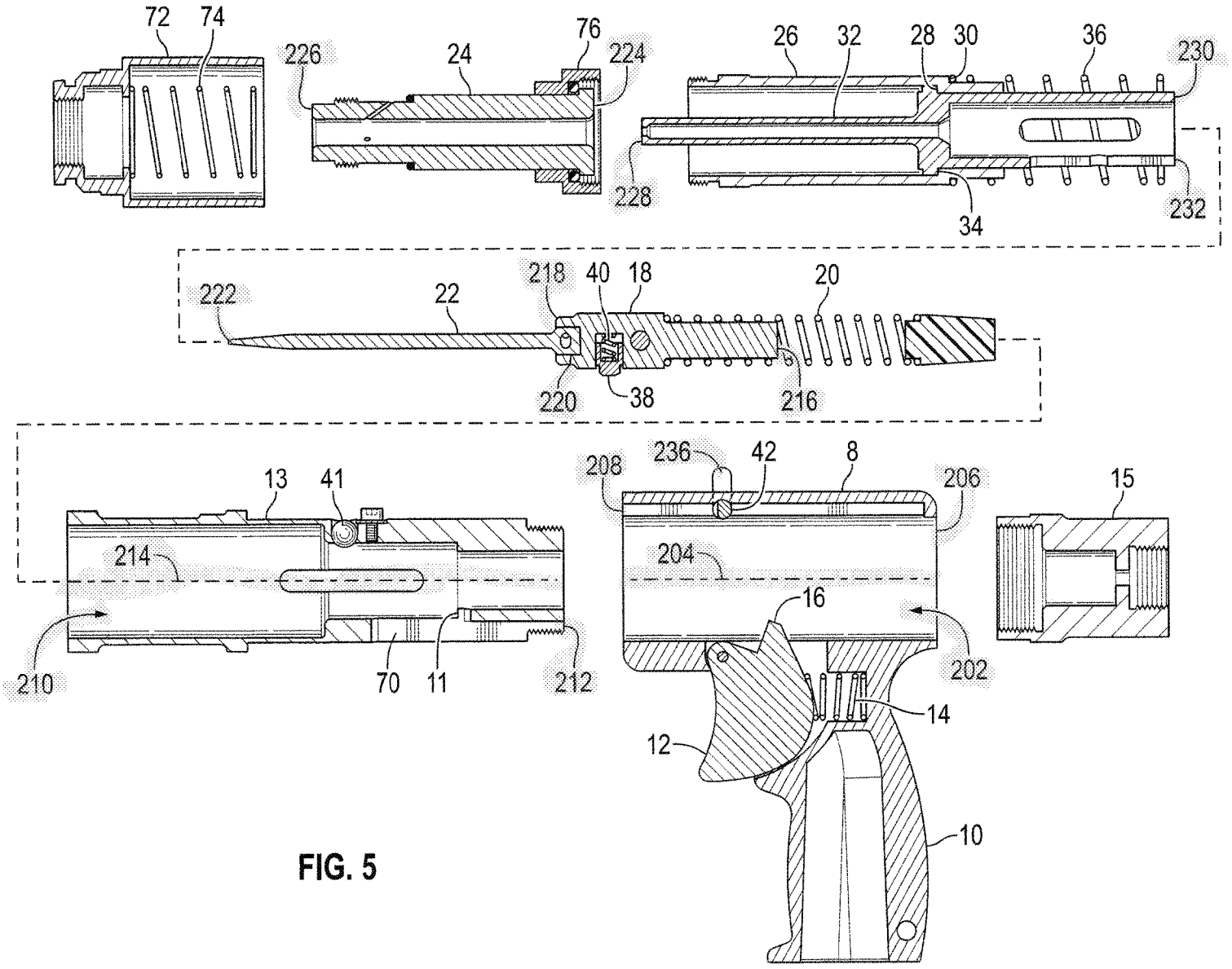
FIG. 5 is an exploded view of the tool of FIGS. 1-4.
Figure 7:
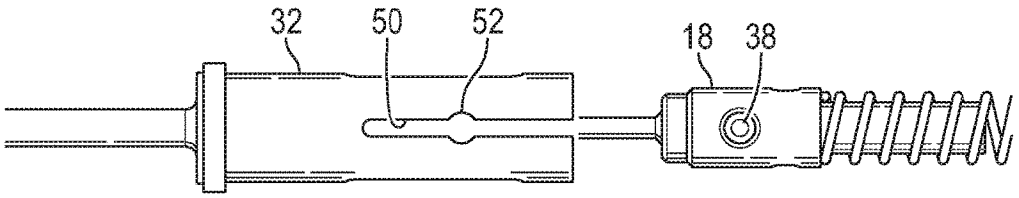
FIG. 7 is a pictorial illustration of some of the parts shown in FIG. 5 illustrating how they go together in greater detail and from another angle.
Figure 6:
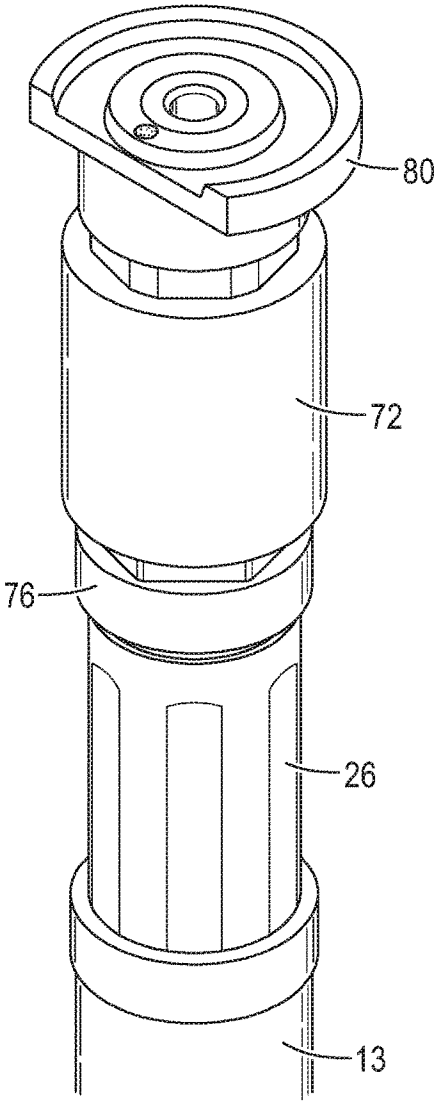
FIG. 6 is a pictorial illustration of an optional feature that can be utilized with the tool of FIGS. 1-5.

In one embodiment of the invention, a tubular debris cup 72 is attached to the nosepiece in a covering coaxial relationship. A threaded reset sleeve cap 76 is positioned on the distal end of the reset sleeve and retains the proximal end of the nosepiece against the distal end of the reset sleeve. A nosepiece spring 74 is positioned between the debris cup and the reset sleeve cap annularly to the nosepiece urging the debris cup distally from the reset sleeve cap and extending the nosepiece to its full distal position. The tubular debris cup rides over the reset sleeve cap and the reset sleeve when the nosepiece spring is compressed. The outer cover sleeve rides over the reset sleeve when the reset sleeve spring is compressed. Compression of the nosepiece spring and the reset sleeve spring brings the distal end of the firing pin guide to a position adjacent the distal end of the nosepiece. See FIG. 4 which shows an unfired fastener assembly being ejected.

Figure 10:
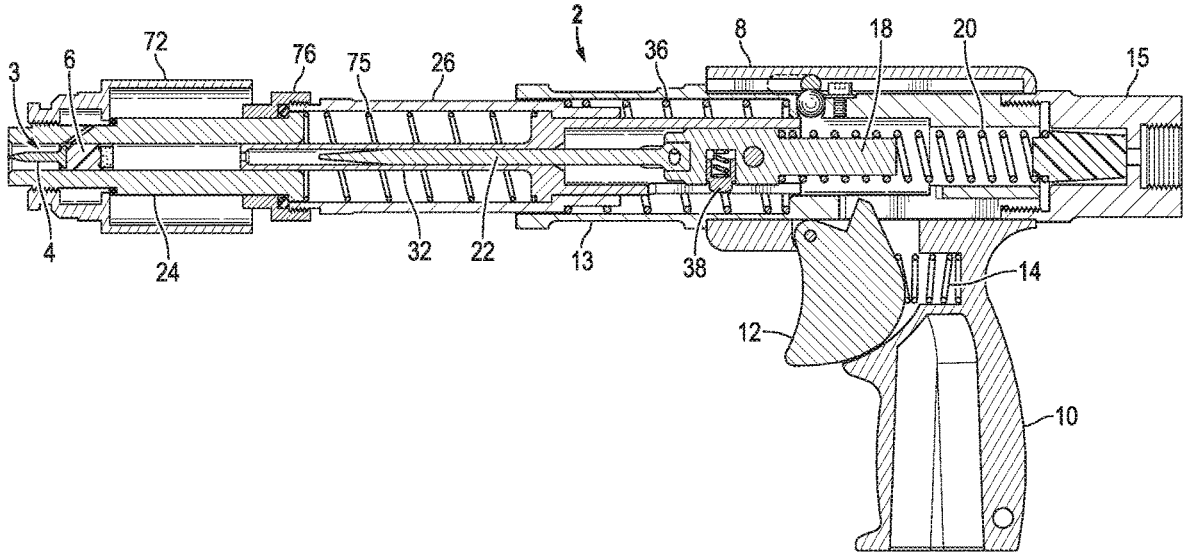
FIG. 10 is a tool as in FIG. 1 but with a modified spring arrangement.

FIG. 10 illustrates an alternative to nosepiece spring 74 in the form of a nosepiece spring 75 positioned between the distally facing annular face of the firing pin guide and the proximally facing annular face on the proximal end of the nosepiece. Springs 74 or 75 urge the nosepiece to the full distal position. Functionally, nosepiece Springs 74 or 75 can be viewed as biasing means for biasing the nosepiece to its fully distally extended position.

These features enable the tool to accept fastener assemblies from 1" to 2½" and be able to eject debris or an unfired fastener assembly and reset the tool properly. The nosepiece is no longer screwed into the reset sleeve. Instead, the nosepiece can travel freely on the firing pin guide and is connected to the reset sleeve by a new reset sleeve cap. The fastener assembly is inserted into the nosepiece. Then the operator will lightly compress the tool until the tip of the nail pushes against the substrate. The tip of the firing pin guide pushes against the charge holding the nail in place. A spring (added between the lip of the firing pin guide and the nosepiece, or between the extended debris cup and the reset spring cap) pushes the nosepiece to full extension. The modified nosepiece can travel into the body of the reset sleeve. During ejection, the nosepiece is first pushed into the reset sleeve reducing the total space inside the nosepiece to less than 40 mm, then the firing pin guide advances 40 mm fully ejecting any plastic or debris stuck inside the nosepiece.

For cocking, the firing pin is carried proximally with proximal movement of the firing pin guide to compress the firing pin spring until the firing pin is released from the firing pin guide.

In some embodiments, a spall shield 80 is mounted to the distal end of the nosepiece to provide greater worker safety for nail sets in concrete.

What is claimed is:

1. A tool for installing an explosively driven fastener, the fastener including a nail and an explosive load attached to the nail, the tool comprising:

an outer cover sleeve defining a bore, a longitudinal axis, a proximal end and a distal end;

a tubular trigger body fixedly positioned in the outer cover sleeve, the tubular trigger body defining a bore having a distally facing arcuate backstop face;

an end cap positioned at a proximal end of the tubular trigger body securing the tubular trigger body to the outer cover sleeve;

a firing pin holder located within the bore of the tubular trigger body and extending along a longitudinal axis of the tubular trigger body, the firing pin holder having a proximal end and a distal end;

a firing spring arranged to bias the firing pin holder distally with respect to the tubular trigger body;

a firing pin having a proximal end and a distal end, the distal end of the firing pin being pointed, the firing pin being separate from the firing pin holder, the proximal end of the firing pin being removably coupled to the distal end of the firing pin holder;

a nosepiece having a proximal end and a distal end, the proximal end of the nosepiece arranged to receive a firing pin guide and the distal end of the nosepiece arranged to receive the explosively driven fastener comprising the nail and the explosive load such that when the explosively driven fastener is placed in the distal end of the nosepiece and the firing pin holder is biased out of the outer cover sleeve by the firing spring, the firing pin strikes the explosive load causing the explosive load to explode and drive the nail out of the nosepiece, a nosepiece spring biasing the nosepiece distally, a tubular reset sleeve having an inner flange facing distally and an outer flange facing proximally, wherein the firing pin guide is carried slidably in the reset sleeve, the firing pin guide having a distal end and a proximal end, the firing pin guide having a proximally facing outer arcuate flange abuttable against the inner flange of the reset sleeve, and an arcuate face at the proximal end of the firing pin guide abuttable against the distally facing arcuate backstop face in the tubular trigger body bore, a reset spring mounted around the firing pin guide and abutting the outer flange of the reset sleeve, the reset spring biasing the reset sleeve distally;

a trigger ball and a trigger ball spring mounted in the firing pin holder, the trigger ball being biased radially outward from within the firing pin holder;

wherein the firing pin guide has a slot extending from the proximal end toward the distal end and a widened area in the slot to receive the trigger ball, wherein when the tool is in an energized position, the trigger ball rests in the widened area of the slot thereby limiting distal movement of the firing pin, and the arcuate face at the proximal end of the firing pin guide abuts the distally facing arcuate backstop face in the trigger body bore.

2. The tool as in claim 1 further comprising an internal trigger shoe extending radially inwardly into the bore of the trigger body distally from the distally facing arcuate backstop face, said shoe being receivable by the slot to depress the trigger ball by sliding over it;

wherein when the tool is in a firing position, the trigger shoe depresses the trigger ball out of engagement with the firing pin guide allowing distal movement of the firing pin under the action of the firing spring as the arcuate end face of the firing pin guide abuts the arcuate backstop face in the trigger body bore.

3. The tool as in claim 2 wherein the distally facing arcuate backstop face is an end face of a tubular backstop carried internally at the proximal end of the trigger body.

4. The tool as in claim 3 wherein the distally facing arcuate backstop face of tubular backstop defines a notch and the trigger shoe is positioned partially in the notch.

5. The tool as in claim 1 further comprising a grip extending transversely from the outer cover sleeve between the proximal end and the distal end, a trigger pivotally connected to the outer cover sleeve and biased distally away from the grip by a trigger spring positioned between the grip and the trigger, said trigger having an upper surface and a nose protruding from the upper surface of the trigger toward the longitudinal axis of the outer cover sleeve, said nose entering the bore of the outer cover sleeve when the trigger is depressed toward the grip;

wherein the tubular trigger body defines a longitudinally extending slot which receives the nose of the trigger when the trigger is depressed toward the grip, and when the tool is in a firing position, the trigger nose depresses the trigger ball out of engagement with the firing pin guide to allow distal movement of the firing pin under the action of the firing spring.

6. The tool as in claim 5 wherein the distally facing arcuate backstop face is unitary with the trigger body.

7. The tool as in claim 5 further comprising a tubular debris cup attached to the nosepiece in a covering coaxial relationship, a threaded reset sleeve cap positioned on the distal end of the reset sleeve and retaining the proximal end of the nosepiece against the distal end of the reset sleeve, and wherein the nosepiece spring is positioned between the debris cup and the reset sleeve cap annularly to the nosepiece urges the debris cup and the nosepiece distally from the reset sleeve cap, wherein the tubular debris cup rides over the reset sleeve cap and the reset sleeve when the nosepiece spring is compressed.

8. The tool as in claim 7 wherein the outer cover sleeve rides over the reset sleeve when the reset sleeve spring is compressed.

9. The tool as in claim 8 wherein compression of the nosepiece spring and the reset sleeve spring brings the distal end of the firing pin guide to a position adjacent the distal end of the nosepiece.

10. The tool as in claim 8 wherein the firing pin is carried proximally with proximal movement of the firing pin guide to compress the firing spring until the firing pin is released from the firing pin guide.

11. The tool as in claim 7 further comprising a spall shield mounted to the distal end of the nosepiece.

12. The tool as in claim 1 further comprising a blocking element carried for radial movement by the tubular trigger body to selectively block proximal movement of the firing pin guide and prevent energization of the firing spring, a cam mounted across the outer cover sleeve, and an arm on one end of the cam to permit about a 90 degree rotation of the cam to selectively block radially outward movement of the blocking element and prevent the firing pin guide from moving sufficiently proximally for the firing spring to be energized.

13. The tool as in claim 12 wherein the blocking element comprises a ball bearing that contacts the distal end of the firing pin guide.

* * * * *